US008195073B2

(12) United States Patent
Sakai

(10) Patent No.: US 8,195,073 B2
(45) Date of Patent: Jun. 5, 2012

(54) FIXING DEVICE AND IMAGE FORMING APPARATUS

(75) Inventor: Masato Sakai, Minato-ku (JP)

(73) Assignee: Oki Data Corporation, Tokyo (JP)

( * ) Notice: Subject to any disclaimer, the term of this patent is extended or adjusted under 35 U.S.C. 154(b) by 468 days.

(21) Appl. No.: 12/357,777

(22) Filed: Jan. 22, 2009

(65) Prior Publication Data

US 2009/0190974 A1 Jul. 30, 2009

(30) Foreign Application Priority Data

Jan. 25, 2008 (JP) ..... 2008-015351

(51) Int. Cl.
*G03G 15/20* (2006.01)

(52) U.S. Cl. ..... 399/323

(58) Field of Classification Search ..... 399/323
See application file for complete search history.

(56) References Cited

U.S. PATENT DOCUMENTS 4,866,485 A * 9/1989 Simpson ..... 399/323
6,564,030 B2 * 5/2003 Baughman et al. ..... 399/323
2007/0116504 A1 * 5/2007 Miller et al. ..... 399/398

FOREIGN PATENT DOCUMENTS

JP 2005-037567 A 2/2005

* cited by examiner

*Primary Examiner* — David Gray
*Assistant Examiner* — Erika J Villaluna
(74) *Attorney, Agent, or Firm* — Panitch Schwarze Belisario & Nadel LLP

(57) ABSTRACT

A fixing apparatus including a fixing member for fixing developer image on a recording medium, and a separation member separating the recording medium from the fixing member to guide the recording medium in a delivery direction of the recording medium. The separation member includes a resin member, a metal member formed on a front side of the resin member, and an opening. In accordance with a preferred aspect of the fixing apparatus, when the developer image is fixed to the recording medium, the opening arranged at the separation member is formed to flow the gas around the fixing apparatus, thereby improving the printing quality of the printed images.

13 Claims, 12 Drawing Sheets

FIXING DEVICE AND IMAGE FORMING APPARATUS

BACKGROUND OF THE INVENTION

1. Field of the Invention

This invention relates to a fixing apparatus and an image forming apparatus having the fixing apparatus.

2. Description of Related Art

A fixing apparatus conventionally makes a recording medium, on which developer images are formed by development of latent images formed on an image carrier with a developing agent, pass though and fixes the developer images formed on the recording medium by a fixing member. Such a fixing apparatus tends to include a metal separation member for separating the recording medium to which the developer image is attached, from the surface of the fixing member (see, e.g., Japanese Unexamined Patent Publication No. 2005-37567).

With such a prior art fixing apparatus, there raises a problem that printing quality made by the image forming apparatus having such a fixing apparatus cannot be good as expected. It is therefore an object of the invention to provide a fixing apparatus improving the printing quality when printing is made with an image forming apparatus having such a fixing apparatus.

SUMMARY OF THE INVENTION

Foregoing objects are accomplished with a fixing apparatus including a fixing member for fixing developer image on a recording medium, and a separation member separating the recording medium from the fixing member to guide the recording medium in a delivery direction of the recording medium. The separation member includes a resin member, a metal member formed on a front side of the resin member, and an opening.

In accordance with a preferred aspect of the fixing apparatus, when the developer image is fixed to the recording medium, the opening arranged at the separation member is formed o flow the gas around the fixing apparatus, thereby improving the printing quality of the printed images.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

DETAILED DESCRIPTION OF PREFERRED EMBODIMENTS

Figure 1:
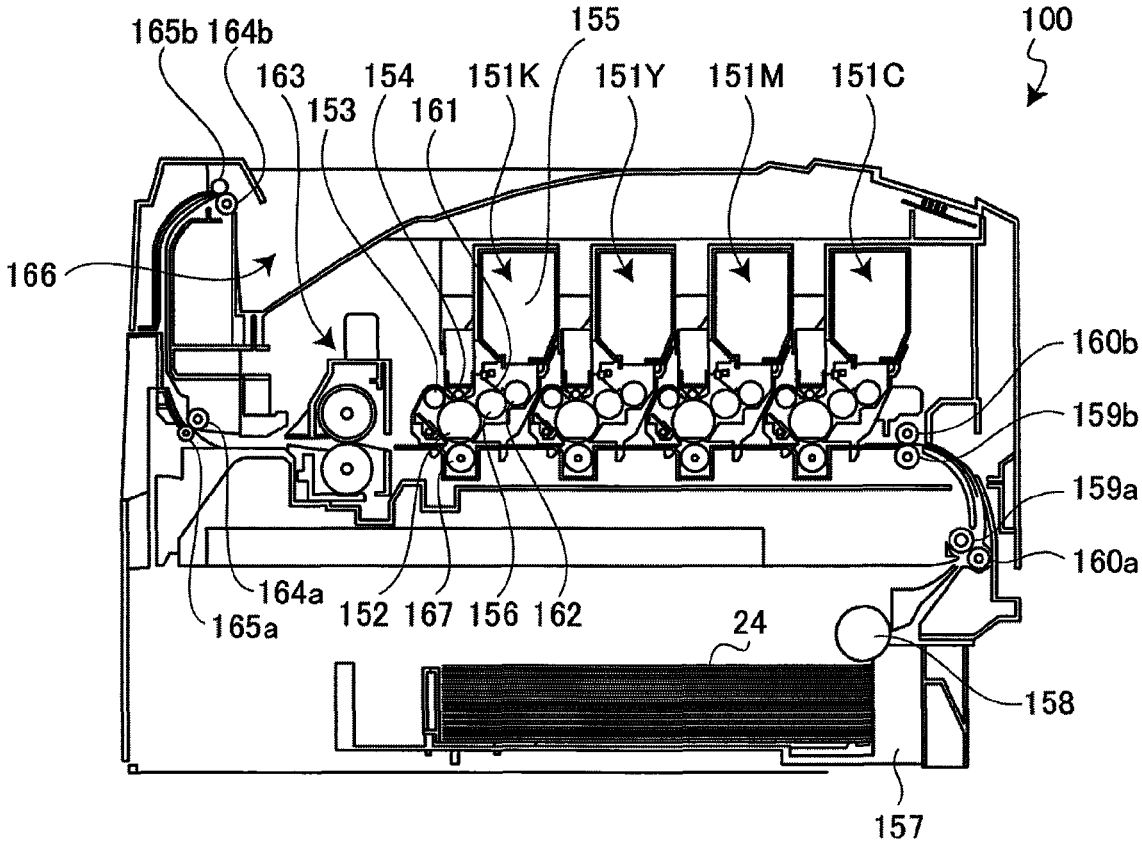
FIG. 1 is a cross section illustrating a structure of an image forming apparatus according to the invention.

Referring to the drawings, preferred embodiments of this invention will be described. This invention is not limited to the embodiments disclosed below but is modifiable as far as not deviated from the subject matter of the invention.

First Embodiment

The image forming apparatus according to this embodiment includes a fixing apparatus mounted on the image forming apparatus. First, an image forming apparatus is described; FIG. 1 is a diagram illustrating the structure of the image forming apparatus.

The image forming apparatus as shown in FIG. 1 includes a paper cassette 157, process units 151C, 151M, 151Y, 151K, a fixing apparatus 163, and respective rollers. Paper 24 as recording medium is contained in the paper cassette 157.

The paper cassette 157 accumulates paper 24 for forming images as shown in FIG. 1 and is formed as a box shaped member at least having an opening at a top surface so as to take out the paper 24. A pickup roller 158 is arranged at the paper cassette 157 as to contact with the paper 24 located in the paper cassette 157. The paper 24 is pulled out sheet by sheet by operation of the pickup roller 158 and is supplied to a conveyance route out of the paper cassette 157.

A pair of feeding rollers 159*a*, 160*a* and a pair of feeding rollers 159*b*, 160*b*, from an upstream side in a conveyance direction of the paper, are arranged in the conveyance route from the paper cassette 157 to the process units 151C, 151M, 151Y, 151K. The paper 24 supplied to the conveyance route by the pickup roller 158 is conveyed toward the feeding rollers 159*b*, 160*b* by the feeding rollers 159*a*, 160*a* provided as to contact to one another with pressure to sandwich the paper 24 by operation as the pair.

The paper 24 is then fed toward the process units 151C, 151M, 151Y, 151K by the feeding rollers 159*b*, 160*b* provided as to contact to one another with pressure to sandwich the paper 24 by operation as the pair.

The process units 151C, 151M, 151Y, 151K are electrophotographic process units corresponding to respective toners as developers in four colors: cyan (C), magenta (M), yellow (Y), and black (K). Each of process units 151C, 151M, 151Y, 151K has a photosensitive drum 152, a charge roller 153 charging a surface of the photosensitive drum 152, an LED (Light Emitting Diode) head 154 for exposing the photosensitive drum based on the inputted image data to form electrostatic latent images, a developing roller 156 for developing electrostatic latent images formed on the surface of the photosensitive drum 152 with toners, a developing blade 161 for uniformly regulating the toner layer formed on the surface of the developing roller 156, a sponge roller 162 for supplying toner to the developing roller 156, and a toner cartridge 155 for containing toner in respective colors.

Image data are converted into a signal in a prescribed format at a printing controller, and the signal is supplied to the LED head 154 in the process units 151C, 151M, 151Y, 151K. The LED head 154 exposes the electrostatic latent image of one line by emitting light emitting devices based on the signal supplied from the printing controller not shown, and does this operation in synchrony with rotation of the photosensitive drum 152. A bias voltage is applied at that time to the surface of the photosensitive drum 152 by the charging roller 153, and the bias voltage is neutralized at the regions exposed with the LED head 154. Toner is supplied to the surface of the developing roller 156 from the toner cartridge 155 via the sponge roller 162, and the developing blade 161 forms a toner layer. The regions exposed with the photosensitive drum 152 are made in contact with the developing roller 156 on which the toner layer is formed, and the toner is attached to the exposed regions, thereby developing on the surface of the photosensitive drum 152 toner images as developer images based on the image information. Thus the process units 151C, 151M, 151Y, 151K produce the toner images in cyan, magenta, yellow, and black.

A transfer roller 167 is provided at a lower portion of each of the process units 151C, 151M, 151Y, 151K for transferring the toner images developed by the photosensitive drum 152 to the conveying paper 24. The conveyed paper 24 is subject to transferring operation such that the respective toner images developed at the process units 151C, 151M, 151Y, 151K are overlapped by a high voltage applied to the respective transfer rollers 167. The paper 24 transferred with the toner images is conveyed to the fixing apparatus 163.

The fixing apparatus 163 includes a fixing roller 2 serving as a fixing member described below, and a pressure roller 4, and makes fixing by applying heat and pressure to the toner images transferred to the paper 24. The paper 24 fixing the toner images thereon is conveyed toward a pair of feeding rollers 164*a*, 165*a* and a pair of feeding rollers 164*b*, 165*b*. The paper 24 is conveyed to a delivery stacker 166 with the pair of feeding rollers 164*a*, 165*a* and the pair of feeding rollers 164*b*, 165*b*.

Figure 2:
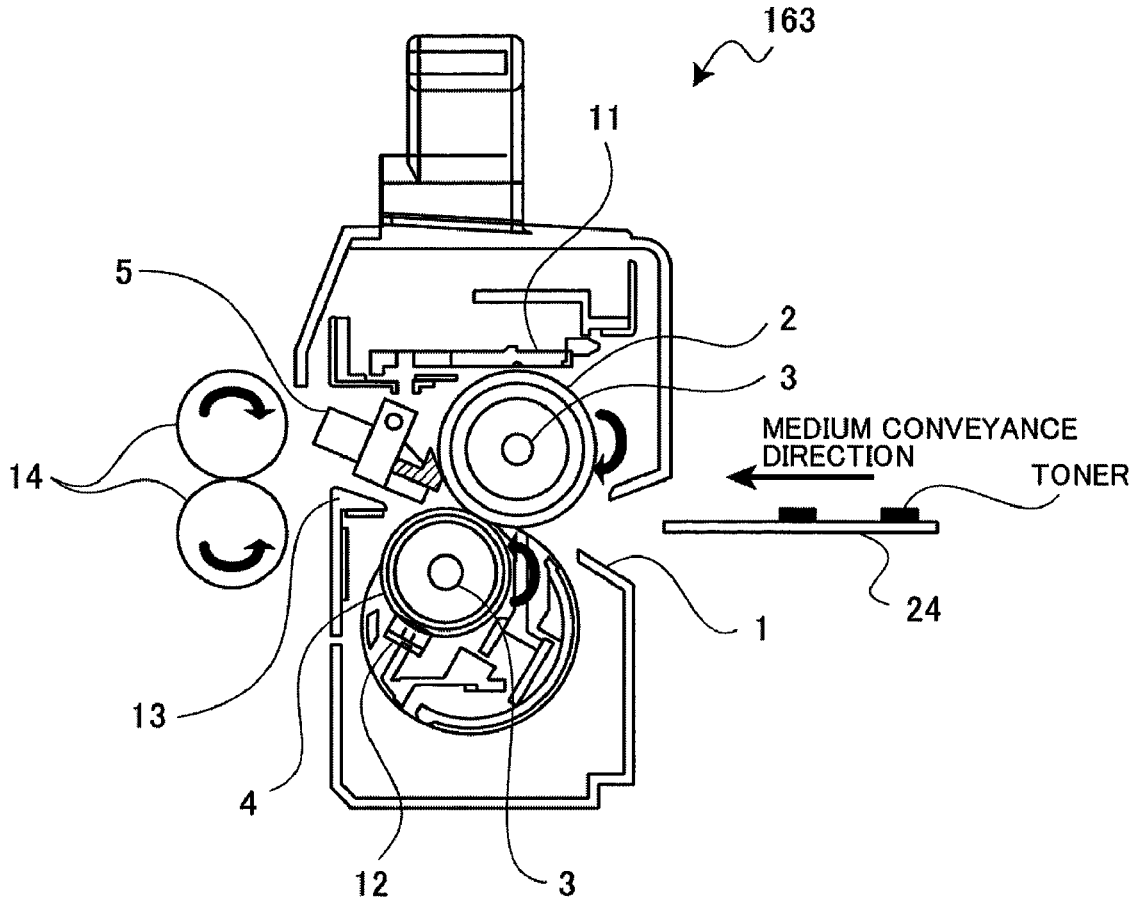
FIG. 2 is a cross section showing a structure of a fixing apparatus according to the invention.

The fixing apparatus 163 mounted in the image forming apparatus 100 as described above is described. FIG. 2 shows a cross section of the fixing apparatus 163.

The fixing apparatus 163 is formed with an entry guide member 1 for guiding the paper 24 fed from the process units 151C, 151M, 151Y, 151K toward the fixing roller 2 and the pressure roller 4. The fixing roller 2 serving as the fixing member and the pressure roller 4 serving as the pressure member are arranged on a downstream side of the conveyance direction of the paper 24 with respect to the entry guide member 1, thereby fixing the toner images transferred onto the paper 24.

The fixing roller 2 includes a core metal made of a metal, such as aluminum or iron, incorporating a halogen lamp 3 inside serving a heater, and an elastic body such as silicone rubber formed on the surface of the core metal. A coating layer or tube having the same function as the coating layer is covered on the surface of the elastic body to ensure separating feature with respect to the toner images transferred onto the paper 24.

The fixing roller 2 is arranged with a non-contacting thermister 11 as to be a predetermined distance away from the surface of the fixing roller 2. The non-contacting thermister 11 measures the temperature of the surface of the fixing roller 2. The fixing roller 2 is so structured that the surface temperature of the fixing roller 2 is controlled by turning on and off the halogen lamp 3 of the fixing roller 2 in accordance with the temperature measured with the non-contacting thermister 11 by means of the temperature control processing means, not shown.

The pressure roller 4 is arranged to face to the fixing roller 2 via the conveyance route for the paper 24. The pressure roller 4 includes a core metal made of a metal, such as aluminum or iron, incorporating a halogen lamp 3 inside serving a heater, and an elastic body such as silicone rubber formed on the surface of the core metal. A coating layer or tube having the same function as the coating layer is covered on the surface of the elastic body to ensure separating feature with respect to the toner images transferred onto the paper 24.

The pressure roller 4 is arranged with a non-contacting thermister 12 as to contact the surface of the pressure roller 2. The non-contacting thermister 12 measures the temperature of the surface of the pressure roller 4. The pressure roller 4 is so structured that the surface temperature of the pressure roller 4 is controlled by turning on and off the halogen lamp 3 of the pressure roller 4 in accordance with the temperature measured with the non-contacting thermister 12 by means of the temperature control processing means, not shown.

This pressure roller 4 is so arranged to contact the surface of the fixing roller 2 in a predetermined pressure by means of a tension spring, not shown. This forms a nipping portion for applying heat and pressure to the paper 24 by contact between the fixing roller 2 and the pressure roller 4 in a predetermined pressure.

A separator 5 is provided as a separation member near the fixing roller 2 on a downstream side in the conveyance direction of the paper 24 with respect to the fixing roller 2 and pressure roller 4. The separator 5 separates from the fixing roller 2 the paper 24 passing by the nipping portion formed by the fixing roller 2 and the pressure roller 4. A molded guide member 13 is arranged near the pressure roller 4 on a downstream side in the conveyance direction of the paper 24 with respect to the fixing roller 2 and the pressure roller 4. The guide member 13 guides the paper 24 to the delivery roller 14 arranged on the downstream side in the conveyance direction together with the separator 5.

A pair of delivery rollers 14 is provided as to sandwich the conveyance route of the paper 24 on a downstream side of the separator 5 and a guide member 13. The delivery rollers 14 are in contact with one another in prescribed pressure, and rotate in nipping the paper 24 to deliver the paper 24 in a direction of the delivery rollers 164*a*, 165*a* as described above.

Figure 3:
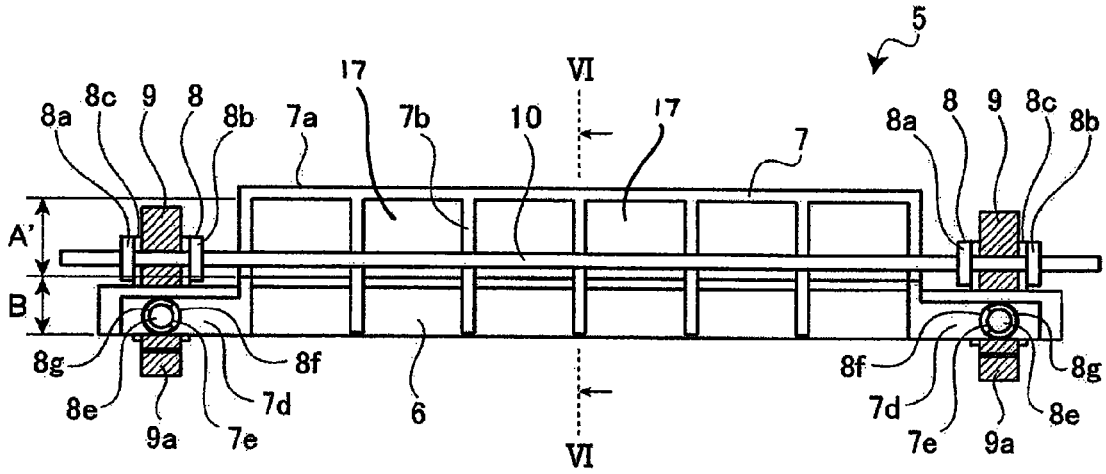
FIG. 3 is a top view showing a separator arranged at the fixing apparatus according to the first embodiment of the invention.
Figure 4:
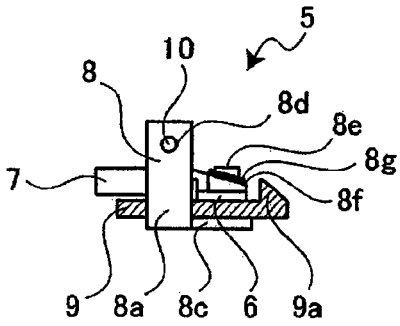
FIG. 4 is a side view showing the separator arranged at the fixing apparatus according to the first embodiment of the invention.
Figure 5:
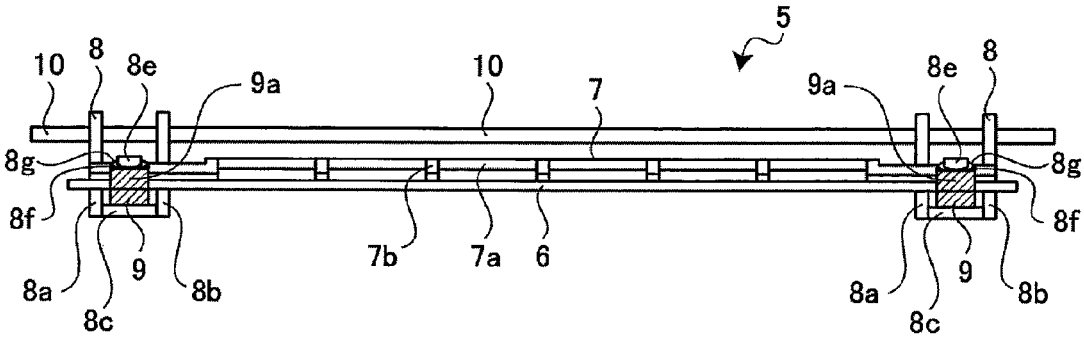
FIG. 5 is a front view showing the separator arranged at the fixing apparatus according to the first embodiment of the invention.
Figure 6:
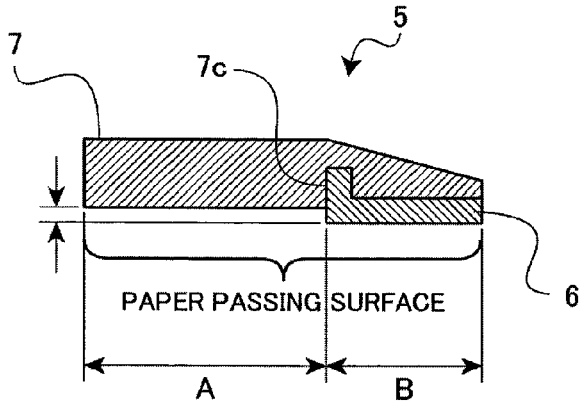
FIG. 6 is a cross section cut along VI-VI line in FIG. 3.

The separator 5 is described in detail. FIG. 3 is a top view of the separator; FIG. 4 is a side view of the separator; FIG. 5 is a front view of the separator; FIG. 6 is a cross section cut along line VI-VI in FIG. 3. The separator 5 is made of a metal plate 6 as a stainless steel metal member, and a sheet guide 7 formed of a heat-resisting resin serving as a resin member.

The metal plate 6 is a plate made of a stainless steel having a thickness of 1.5 mm and bent so that the cross-sectional shape becomes a letter L-shape to obtain rigidity against bending. A preferred mold releasing agent such as, e.g., polytetrafluoroethylene or other fluoric resins is coated on a surface of the metal plate 6. A hole 6*e* is drilled at each end in the longitudinal direction of the metal plate for penetrating a post 8*e* formed on a plate 8 described below.

The sheet guide 7 is made of a member made of a heat-resisting resin such as, e.g., epoxy resin having a prescribed thickness. The sheet guide 7 has a shape with a sheet guide body 7*a* as a base, and plural protruding portions 7*b* perpendicularly extending from the longitudinally extending sheet guide body 7*a*. An extending portion 7*d* is formed at each side end in the longitudinally extending direction of the sheet guide body 7*a*. A hole 7*e* is drilled at the expending portion 7*d* for allowing penetration of the post 8*e* formed on the plate 8 described below.

A letter L shaped cutoff 7*c* is formed at each protruding portion 7*b* as to fit the shape of the metal plate 6 bent in the letter L shape. The metal plate 6 is attached to the sheet guide 7 by fitting the metal plate 6 at the portion bent in the L-shape into the cutoff 7*c*. As shown in FIG. 6, where the metal plate 6 is arranged at the cutoff 7*c* of the sheet guide 7, a paper passing surface, or namely a guide surface for guiding the paper 24 in the delivery direction, of the metal plate 6 is projected more than a paper passing surface of the sheet guide 7. This arrangement never prevents the paper 24 from being smoothly conveyed. It is to be noted that where a width A is set as a distance from one end of the sheet guide body 7*a* to the cutoff 7*c* and where a width B is set as the width of the metal plate 6, a relation that the width A is greater than the width B (A>B) is shown. The sheet guide 7 having this metal plate 6 is disposed so that the metal plate 6 is placed more adjacently to the fixing roller 2 than the sheet guide body 7*a*. This structure creates openings 17 between the metal plate 6 and the sheet guide body 7*a*. In FIG. 3, a width A' of the opening 17 formed between the metal plate 6 and the sheet guide 7 is designed equal to or greater than the width B of the metal plate 6.

A bracket 8 formed of a plated steel plate bent in substantially a letter U shape as to open a top side is provided at each end in the longitudinal direction of the metal plate 6 and the sheet guide 7. Holes 8*d* for penetrating a metal shaft 10 are formed in two side portions 8*a*, 8*b* facing to each other of the bracket 8 formed in substantially the letter U shape. The post 8*e* is formed at a bottom portion 8*c* connecting the two side portions 8*a*, 8*b* for penetrating the hole 6*e* of the metal plate 6 and the hole 7*e* of the sheet guide 7.

A spacer 9 is provided for the post 8*e*. The spacer 9 is a member having a tapered front edge 9*a* and has a hole 9*e* for allowing the post 8*e* penetrating. The spacer 9 is made of a heat resisting resin. The spacer 9 is in contact with a surface of the fixing roller 2 and keeps constant distances with the fixing roller 2 and the metal plate 6.

Figure 7:
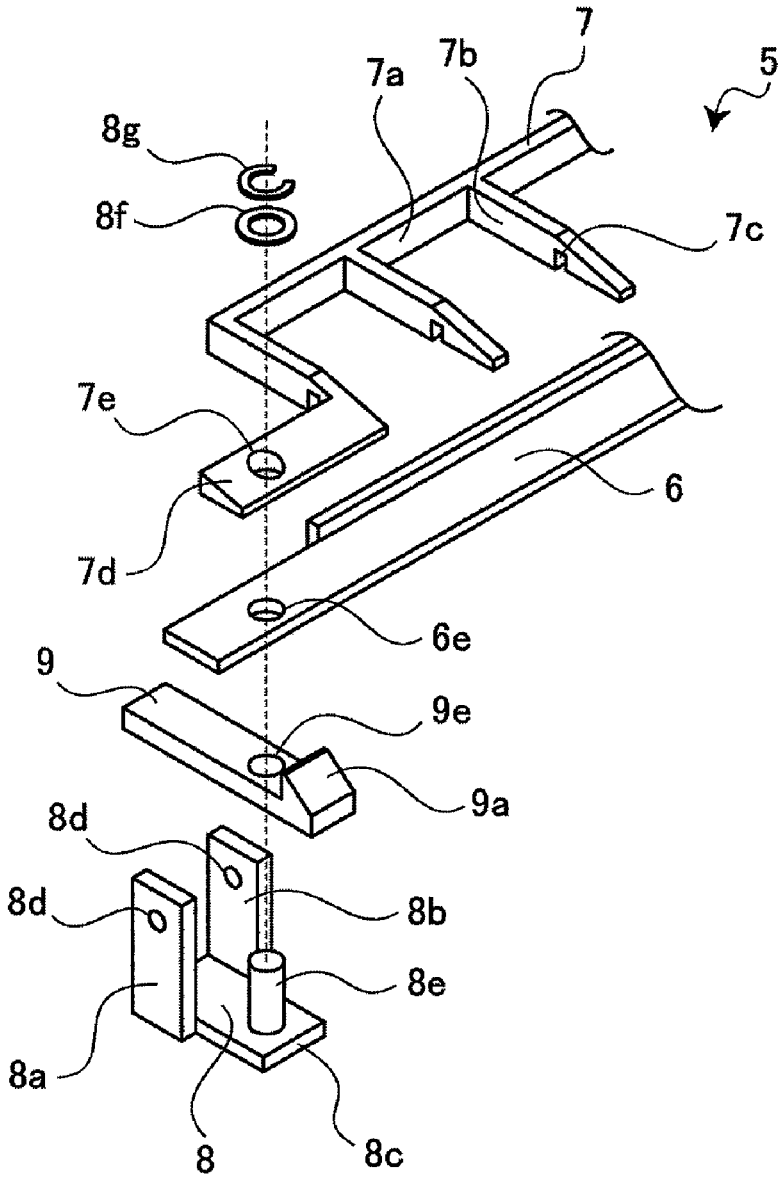
FIG. 7 is an exploded perspective view showing the separator arranged at the fixing apparatus according to the first embodiment of the invention.

FIG. 7 is an exploded perspective view of the separator. The spacer 9 is formed so that the post 8*e* of the bracket 8 is penetrated through the hole 9*e* of the spacer 9. The two brackets 8 having the spacer 9 are assembled by penetrating the post 8*e* through the hole 6*e* formed at each end of the metal plate 6 and through the hole 7*e* formed at each end of the sheet guide 7 while the metal plate 6 is fitted in the sheet guide 7. The front edge 9*a* of the spacer 9 is arranged at that time more closely to the fixing roller 2 than the metal plate 6. The bracket 8 is secured to each end of the metal plate 6 and the sheet guide 7 upon placing a washer 8*f* and a stopper ring 8*g* to the tip of the post 8*e*. The shaft 10 is made to penetrate the holes 8*d* of the bracket 8 provided at each end of the metal plate 6 and the sheet guide 7, thereby securing the separator 5 to the fixing apparatus 163. The separator 5 is arranged so that the front edge 9*a* of the spacer 9 contacts in a prescribed pressure to a non-printing region positioned at each end in the longitudinal direction on the surface of the fixing roller 2.

The fixing apparatus 163 thus structured turns on the halogen lamp 3 so as to render the surface temperature of the fixing roller 2 and the pressure roller 4 become a predetermined temperature with operation of the temperature control processing means, not shown, upon powering on the image forming apparatus 100. When the temperature of the fixing roller 2 and the pressure roller 4 reaches the predetermined temperature, the fixing apparatus 163 enters in a status capable of fixing, so that an instruction for printing start comes out to the image forming apparatus 100. The paper 24 is conveyed out of the paper cassette 157 as described above, and the toner images formed at the respective process units 151C, 151M, 151Y, 151K are transferred to the conveyed paper 24. The paper 24 transferred with the toner images is conveyed to a loading opening of the fixing apparatus 163 and sent to the nipping portion constituted of the fixing roller 2 and the pressure roller 4 heated by the halogen lamp 3. The toner images are fixed to the paper 24 by heat and pressure from the fixing roller 2 and the pressure roller 4 at the nipping portion. The paper 24 to which the toner image is fixed, is separated from the fixing roller 2 by the separator 5.

At a time when the paper 24 is conveyed to the nipping portion, moisture contained in the paper 24 is evaporated with heat generated during fixing operation to generate vapor. The generated vapor may be brought into a space on a downstream side with respect to the nipping portion, but comes out of openings 17 formed at the sheet guide 7 and the metal plate 6 forming the separator 5 to escape upwardly, so that the separator 5 can prevent moisture from attaching to the paper 24.

Because the metal plate 6 constituting the separator 5 is located on the side of the fixing roller 2, the separator 5 does not deform itself even where heated by the surface temperature of the fixing roller 2, so that a gap between the fixing roller 2 and the metal plate 6 is kept to have a certain distance. The sheet guide 7 can minimize deformation of the sheet guide 7 due to heat by the combination with the metal plate 6.

The paper 24 separated away from the fixing roller 2 is made to pass the conveyance surface on the separator 5, and further conveyed on a downstream side by the delivery rollers 14, and is thereby delivered out of the image forming apparatus 100.

Figure 8:
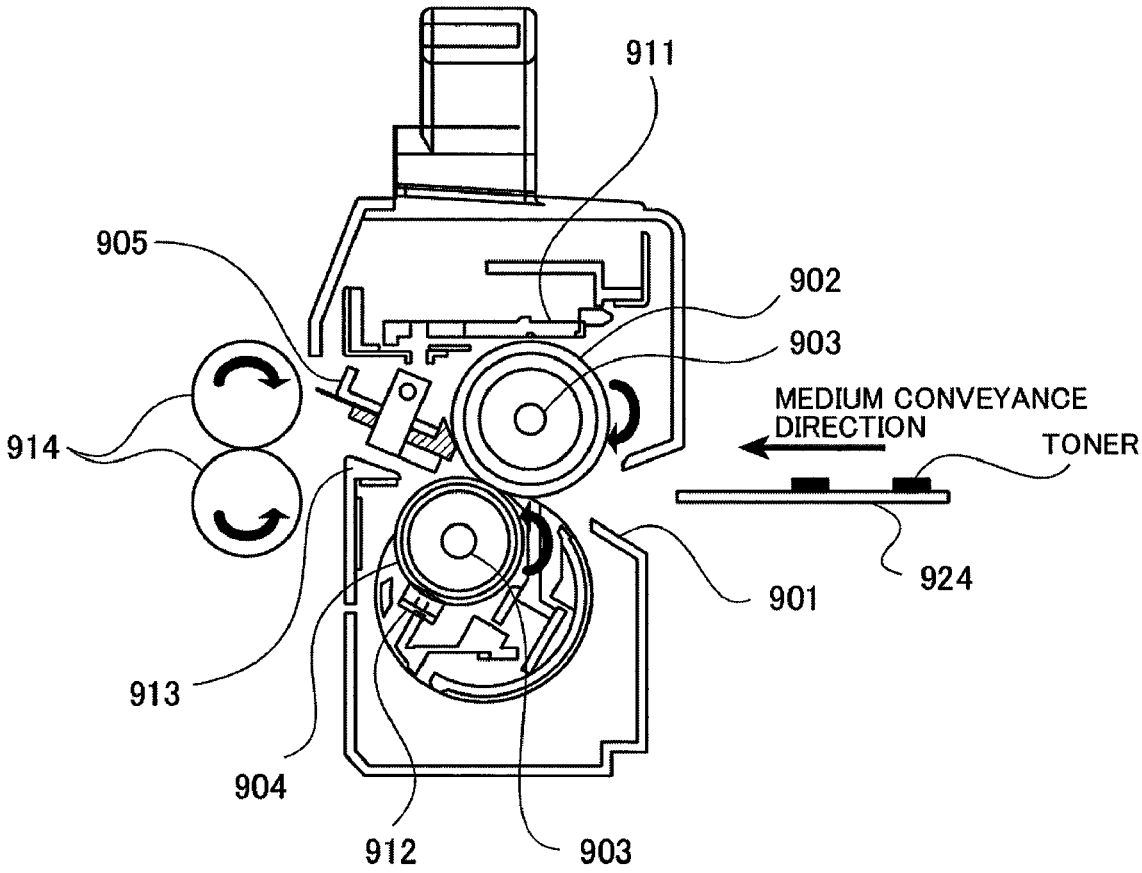
FIG. 8 is a cross section showing a fixing apparatus as a comparative example.

Now, the advantages according to the embodiment is firmed in comparing the fixing apparatus 163 according to this embodiment with a fixing apparatus as a comparative example. FIG. 8 shows a cross section of a fixing apparatus as a comparative example.

The fixing apparatus as a comparative example is formed with an entry guide member 901 for guiding the paper 924 fed toward the fixing roller 902 and the pressure roller 904. The fixing roller 902 and the pressure roller 904 are arranged on a downstream side of the conveyance direction of the paper 924 with respect to the entry guide member 901, thereby fixing the toner images transferred onto the paper 924 by the fixing roller 902 and the pressure roller 904.

The fixing roller 902 includes a core metal made of a metal, such as aluminum or iron, incorporating a halogen lamp 903 inside serving a heater, and an elastic body such as silicone rubber formed on the surface of the core metal. A coating layer or tube having the same function as the coating layer is covered on the surface of the elastic body to ensure separating feature with respect to the toner images transferred onto the paper 924. The fixing roller 902 is arranged with a non-contacting thermister 911 as to be a predetermined distance away from the surface of the fixing roller 902. The non-contacting thermister 911 measures the temperature of the surface of the fixing roller 902.

The pressure roller 904 is arranged to face to the fixing roller 902 via the conveyance route for the paper 924. The pressure roller 904 includes a core metal made of a metal, such as aluminum or iron, incorporating a halogen lamp 903 inside serving a heater, and an elastic body such as silicone rubber formed on the surface of the core metal. A coating layer or tube having the same function as the coating layer is covered on the surface of the elastic body to ensure separating feature with respect to the toner images transferred onto the paper 924. The pressure roller 904 is arranged with a non-contacting thermister 912 as to contact the surface of the pressure roller 902. The non-contacting thermister 912 measures the temperature of the surface of the pressure roller 904.

This pressure roller 904 is so arranged to contact the surface of the fixing roller 902 in a predetermined pressure by means of a tension spring, not shown. This forms a nipping portion for applying heat and pressure to the paper 924 by contact between the fixing roller 902 and the pressure roller 904 in a predetermined pressure.

A separator 905 is provided as a separation member near the fixing roller 902 on a downstream side in the conveyance direction of the paper 924 with respect to the fixing roller 902 and pressure roller 904. The separator 905 separates from the fixing roller 902 the paper 924 passing by the nipping portion formed by the fixing roller 902 and the pressure roller 904. A molded guide member 913 is arranged near the pressure roller 904 on a downstream side in the conveyance direction of the paper 924 with respect to the fixing roller 902 and the pressure roller 904. The guide member 913 guides the paper 924 to the delivery roller 914 arranged on the downstream side in the conveyance direction together with the separator 905.

A pair of delivery rollers 914 are provided as to sandwich the conveyance route of the paper 924 on a downstream side of the separator 905 and a guide member 913. The delivery rollers 914 are in contact with one another in prescribed pressure, and rotate in nipping the paper 924 to deliver the paper 924.

Figure 9:
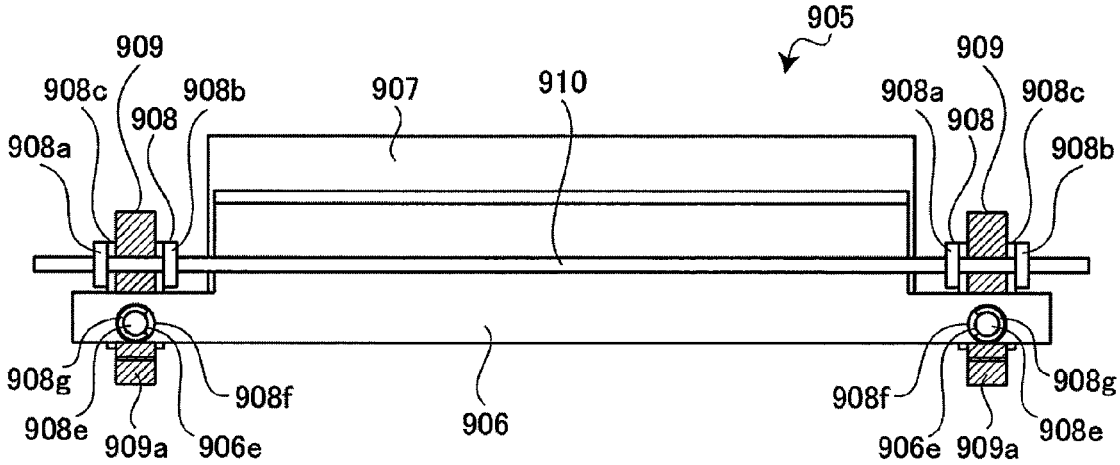
FIG. 9 is a top view showing a separator arranged at the fixing apparatus as the comparative example.
Figure 10:
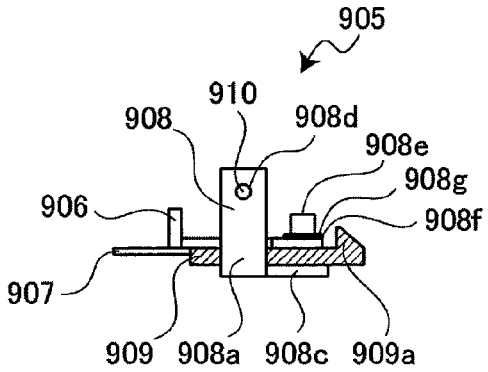
FIG. 10 is a side view showing the separator arranged at the fixing apparatus as the comparative example.
Figure 11:
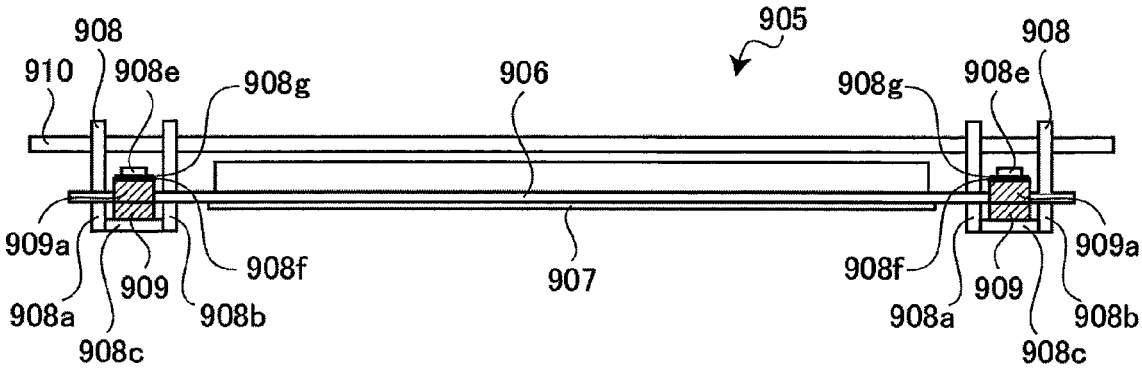
FIG. 11 is a front view showing the separator arranged at the fixing apparatus as the comparative example.

The separator 905 incorporated in the fixing apparatus, serving as the comparative example, is described in detail. FIG. 9 is a top view of the separator; FIG. 10 is a side view of the separator; FIG. 11 is a front view of the separator. The separator 905 is made of a first metal plate 906 and a second metal plate 907, two sheets constituted of upper and lower sheets.

The first metal plate 906 is a stainless steel plate having a thickness of 1.5 mm and is bent so that the cross-sectional shape becomes a letter L-shape to obtain rigidity against bending. A hole 906*e* is formed at each end of the first metal plate 906 in the longitudinal direction for allowing a post 908*e* formed on a bracket 908 as described below penetrating.

The second metal plate 907 is a stainless steel plate having a thickness of 0.3 mm. The first metal plate 906 and the second metal plate 907 are made as a united body by spot-welding the plates in a manner overlapping the plates in up and down direction.

The bracket 908 in which a plated steel plate is bent in a letter U shape as to open a top side is arranged to each end in the longitudinal direction of the overlapped first and second metal plates 906, 907. Holes 908*d* for allowing a metal shaft 910 to penetrate are formed at two side portions 908*a*, 908*b* facing to one another of the bracket 908 formed in the U shape. A post 908*e* is formed at a bottom portion 908*c* connecting the two side portions 908*a*, 908*b* to penetrate the hole 906*e* of the first metal plate 906.

A spacer 909 is provided to the post 908*e*. The spacer 909 is a member having a tapered front edge 909*a* and has a hole 909*e* for allowing the post 908*e* penetrating.

Figure 12:
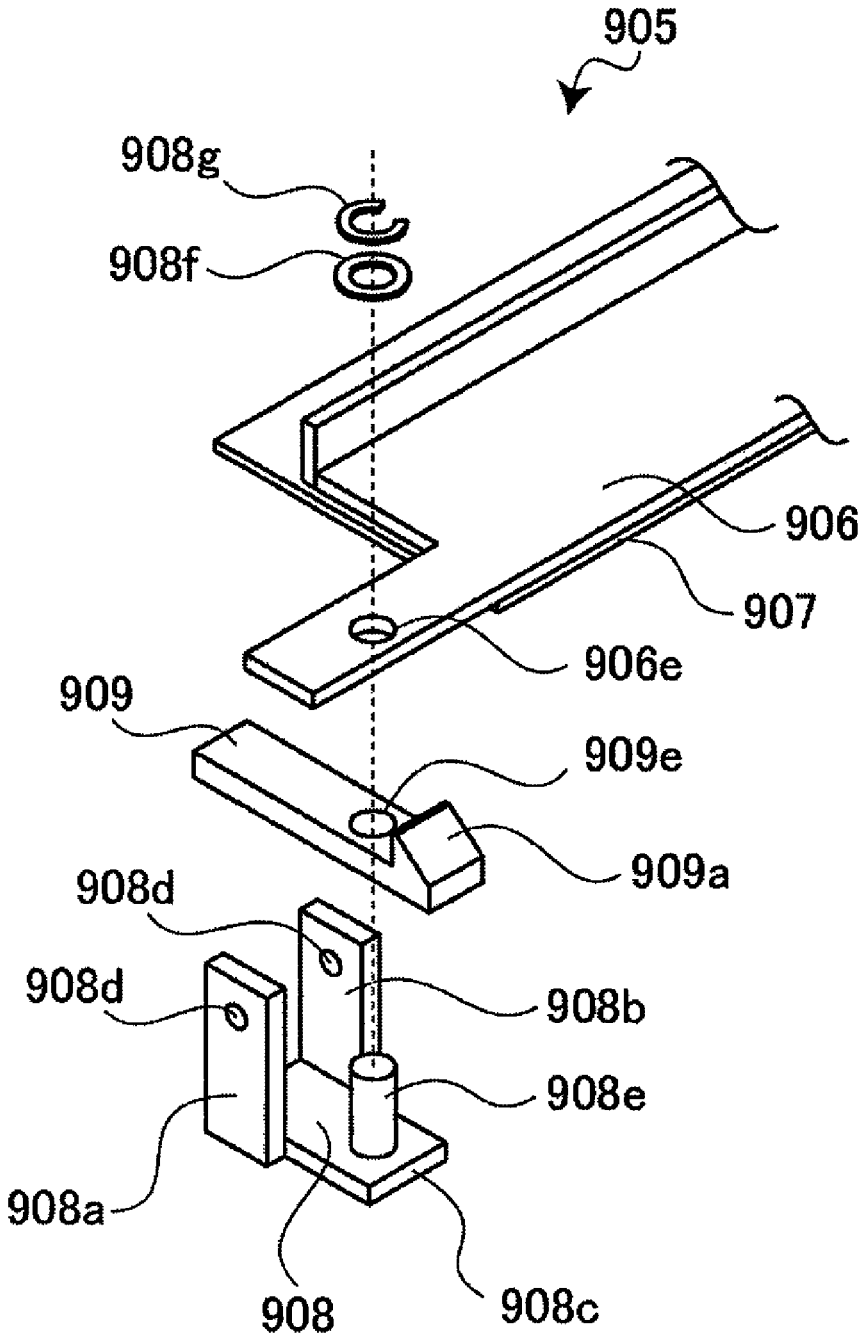
FIG. 12 is an exploded perspective view showing the separator arranged at the fixing apparatus as the comparative example.

FIG. 12 is an exploded perspective view of the separator as the comparative example. The spacer 909 is formed so that the post 908*e* of the bracket 908 is penetrated through the hole 909*e* of the spacer 909. The two brackets 908 having the spacer 909 are assembled by penetrating the post 908*e* through the hole 906*e* formed at each end of the first metal plate 906 while the first metal plate 906 is overlapped to the second metal plate 907. The front edge 909*a* of the spacer 909 is arranged at that time more closely to the fixing roller 902 than any part of the separator 905. The bracket 908 is secured to each end of the first metal plate 906 upon placing a washer 908*f* and a stopper ring 908*g* to the tip of the post 908*e*. The shaft 910 is made to penetrate the holes 908*d* of the bracket 908 provided at each end of the first metal plate 906, thereby securing the separator 905 to the fixing apparatus as the comparative example. The separator 905 is arranged so that the front edge 909*a* of the spacer 909 contacts in a prescribed pressure by a spring, not shown, to a non-printing region positioned at each end in the longitudinal direction on the surface of the fixing roller 902.

The fixing apparatus as the comparative example as described above turns on the halogen lamp 903 so as to render the surface temperature of the fixing roller 902 become a predetermined temperature (e.g., 150 to 180 degrees Celsius) with operation of the temperature control processing means, not shown, upon powering on the image forming apparatus. At that time, the halogen lamp 903 is turned on so that the surface temperature of the pressure roller 904 becomes the predetermined temperature. When the temperature of the fixing roller 902 and the pressure roller 904 reaches the predetermined temperature, the fixing apparatus enters in a status capable of fixing, so that an instruction for printing start comes out to the image forming apparatus and that the paper 924 is conveyed. The toner images formed at the respective process units are transferred to the conveyed paper 924. The paper 924 transferred with the toner images is conveyed to a loading opening of the fixing apparatus as the comparative example and sent to the nipping portion constituted of the fixing roller 902 and the pressure roller 904 heated by the halogen lamp 903. The toner images are fixed to the paper 924 by heat and pressure from the fixing roller 902 and the pressure roller 904 at the nipping portion. The paper 924 to which the toner image is fixed, is separated from the fixing roller 902 by the separator 905. The paper 924 separated from the fixing roller 902 passes through a position between separator 905 and the guide member 913, and is conveyed on the downstream side by the delivery rollers 914, thereby being delivered to an exterior of the image forming apparatus.

With such a conventional fixing apparatus, where printing operation is made immediately after turning on the power of the apparatus, vapor from the recording medium after the fixing operation may attach to the separator and cause water droplets thereon because the separator is not warmed at all. Accordingly, where the recording medium comes to contact the separator on which water droplets may be attached at the delivery of the recording medium, the water droplets then attach to the recording medium, and there raises a problem that the printed recording medium may become corrugated.

Using the fixing apparatus thus structured serving as the comparative example and the fixing apparatus 163 according to this embodiment, it was compared as to whether water drops were attached to the paper or not in a condition that printing was made on the paper left in a moisturized environment (28 degrees Celsius, humidity 80%) immediately after the image forming apparatus was powered on. The results are shown in Table 1 below. In Table 1, a result that water drops did not attach to the paper 24 is represented as "P" (pass); a result that water drops attached to the paper is represented as "F" (fail).

TABLE 1

| | Printing Sheet Number | | | | | | | | | |
|---|---|---|---|---|---|---|---|---|---|---|
| | 1 | 2 | 3 | 4 | 5 | 6 | 7 | 8 | 9 | 10 |
| Separator as Comparative Example | P | F | F | F | F | F | F | F | P | P |
| Separator as First Embodiment | P | P | P | P | P | P | P | P | P | P |

Printing was made immediately after power-on at an apparatus left in a low temperature environment (10 degrees Celsius, humidity 20%) with a medium left in a highly moisturized environment (28 degrees Celsius, humidity 80%).

In a case of the fixing apparatus 163 of this embodiment, no moisture or liquid attaching to the paper was confirmed. On the other hand, in a case of the fixing apparatus as the comparative example, no moisture attaching to the paper was confirmed at a printing time of the first sheet, but some moisture or liquid attaching to the paper was confirmed by own eyes at the second sheet or later. This is because the vapor generated at the printing of the first sheet was attached to the separator as water droplets. No moisture or liquid was confirmed at the ninth sheet or later by increase of the temperature of the separator according to the increase of the printing sheet number.

With the fixing apparatus 163 according to the embodiment of the invention, the sheet guide 7 formed in the comb shape forms the openings 17 with the metal plate 6 to reduce the contacting area with the paper 24, thereby reducing an amount of water droplets attaching due to contacts between the separator 5 and the paper 24. The vapor generated at the paper 24 at the time of the fixing operation can be escaped from the openings 17 upwardly, so that an amount of the water droplets attaching to the separator 5 is minimized. Because the metal plate 6 constituting the separator 5 is arranged more adjacent to the fixing roller 2 with respect to the sheet guide body 7*a*, the gap between the fixing roller 2 and the metal plate 6 is kept in a constant distance, so that the separating feature of the paper 24 from the fixing roller 2 is not deteriorated. In addition, the width A is set greater than the width B. That is, because the region that the sheet guide 7 made of a resin is facing to the paper is greater than the region that the metal plate 6 made of a metal is facing to the paper, the fixing apparatus 163 can reduce an amount of water vapor attaching as droplets on the metal plate 6. Consequently, a water droplet amount attaching the separator 5 is reduced. Furthermore, the width A' is equal to or greater than the width B. That is, the amount of water vapor evaporating upward is greater than the amount of water vapor contacting to the metal plate 6. Therefore, the amount of water droplets attaching to the separator 5 is reduced.

Second Embodiment

An image forming apparatus and a fixing apparatus described in the second embodiment are the image forming apparatus and the fixing apparatus described in the first embodiment to which a separator having another shape is added. Hereinafter, the image forming apparatus and the fixing apparatus are described, but descriptions about substantially the same members as those in the first embodiment are omitted in the second embodiment.

Figure 13:
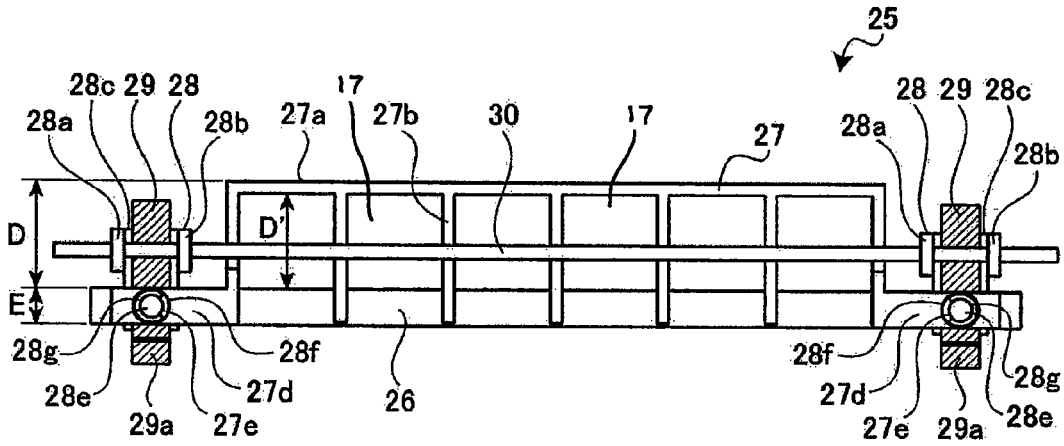
FIG. 13 is a top view showing a separator arranged at the fixing apparatus according to the second embodiment of the invention.
Figure 14:
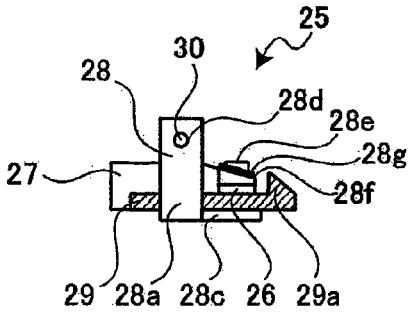
FIG. 14 is a side view showing the separator arranged at the fixing apparatus according to the second embodiment of the invention.
Figure 15:
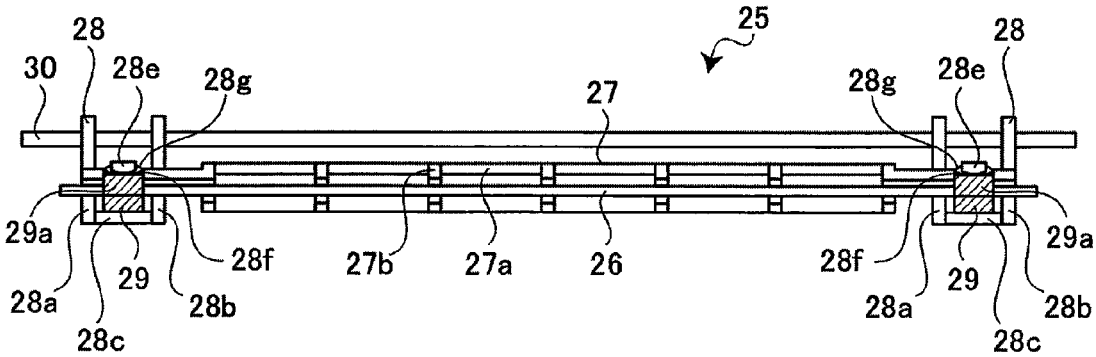
FIG. 15 is a front view showing the separator arranged at the fixing apparatus according to the second embodiment of the invention.

FIG. 13 is a top view of a separator; FIG. 14 is a side view of the separator; FIG. 15 is a front view of the separator. The separator 25 is made of a stainless steel metal plate 26 and a sheet guide 27 formed of a heat resisting resin.

The metal plate 26 is a stainless steel plate having a thickness (e.g., 1.5 mm or greater) more than that of the metal plate described in the first embodiment. It is to be noted that the metal plate 26 is not bent as shown in the first embodiment. An amount of curling in the horizontal direction can be reduced because the rigidity of the metal plate 26 becomes higher than that in the first embodiment by making thicker the thickness of the metal plate 26, so that deformation due to the surface temperature of the fixing roller 2 can be prevented. A hole 26*e* is formed in the metal plate 26 at each end in the longitudinal direction for allowing a post 28*e* formed on the bracket 28 penetrating.

The sheet guide 27 is a member made of a heat resisting resin having a prescribed thickness. The sheet guide 27 has a shape with a sheet guide body 27*a* as a base, and plural protruding portions 27*b* perpendicularly extending from the longitudinally extending sheet guide body 27*a*. An extending portion 27*d* is formed at each side end in the longitudinally extending direction of the sheet guide body 27*a*. A hole 27*e* is drilled at the expending portion 27*d* for allowing penetration of the post 28*e* formed on the plate 28 described below.

A cutoff 27*c* is formed at each protruding portion 27*b* as to fit the shape of the metal plate 26. The cutoff 27*c* is in a shape cut off in a letter U shape corresponding to the thickness of the metal plate 26 from a tip of the protruding portion 27*b* toward the sheet guide body 27*a*. The metal plate 26 can be assembled by inserting the metal plate 26 into the cutoffs 27*c*. That is, the cutoffs 27*c* formed in the protruding portions 27*b* protruding in a comb shape are structured to contact to the front and back surfaces of the metal plate 26, and therefore, the metal plate 26 does not directly contact to the paper 24 by assembling the metal plate 26 to the cutoffs 27*c*. It is to be noted that where a width D is set as a distance from one end of the sheet guide body 27*a* to the cutoff 27*c* and where a width E is set as the width of the metal plate 26, a relation that the width D is greater than the width E (D>E) is shown. A width D' of the opening 17 formed between the metal plate 26 and the sheet guide 27 is equal to or greater than the width E of the metal plate 26. The sheet guide 27 having this metal plate 26 is disposed so that the metal plate 26 is placed more adjacently to the fixing roller 2 than the sheet guide body 27*a*. This structure creates openings 17 between the metal plate 26 and the sheet guide body 27*a*. The width E of the metal plate 26 is smaller than the width B of the metal plate 6 in the first embodiment, so that the opening 17 is made wider in comparison with the first embodiment.

A bracket 28 formed of a plated steel plate bent in substantially a letter U shape as to open a top side is provided at each end in the longitudinal direction of the metal plate 26 and the sheet guide 27. Holes 28*d* for penetrating a metal shaft 30 are formed in two side portions 28*a*, 28*b* facing to each other of the bracket 28 formed in substantially the letter U shape. The post 28*e* is formed at a bottom portion 28*c* connecting the two side portions 28*a*, 28*b* for penetrating the hole 26*e* of the metal plate 26 and the hole 27*e* of the sheet guide 27.

A spacer 29 is provided for the post 28*e*. The spacer 29 is a member having a tapered front edge 29*a* and has a hole 29*e* for allowing the post 28*e* penetrating. The spacer 29 is made of a heat resisting resin.

Figure 16:
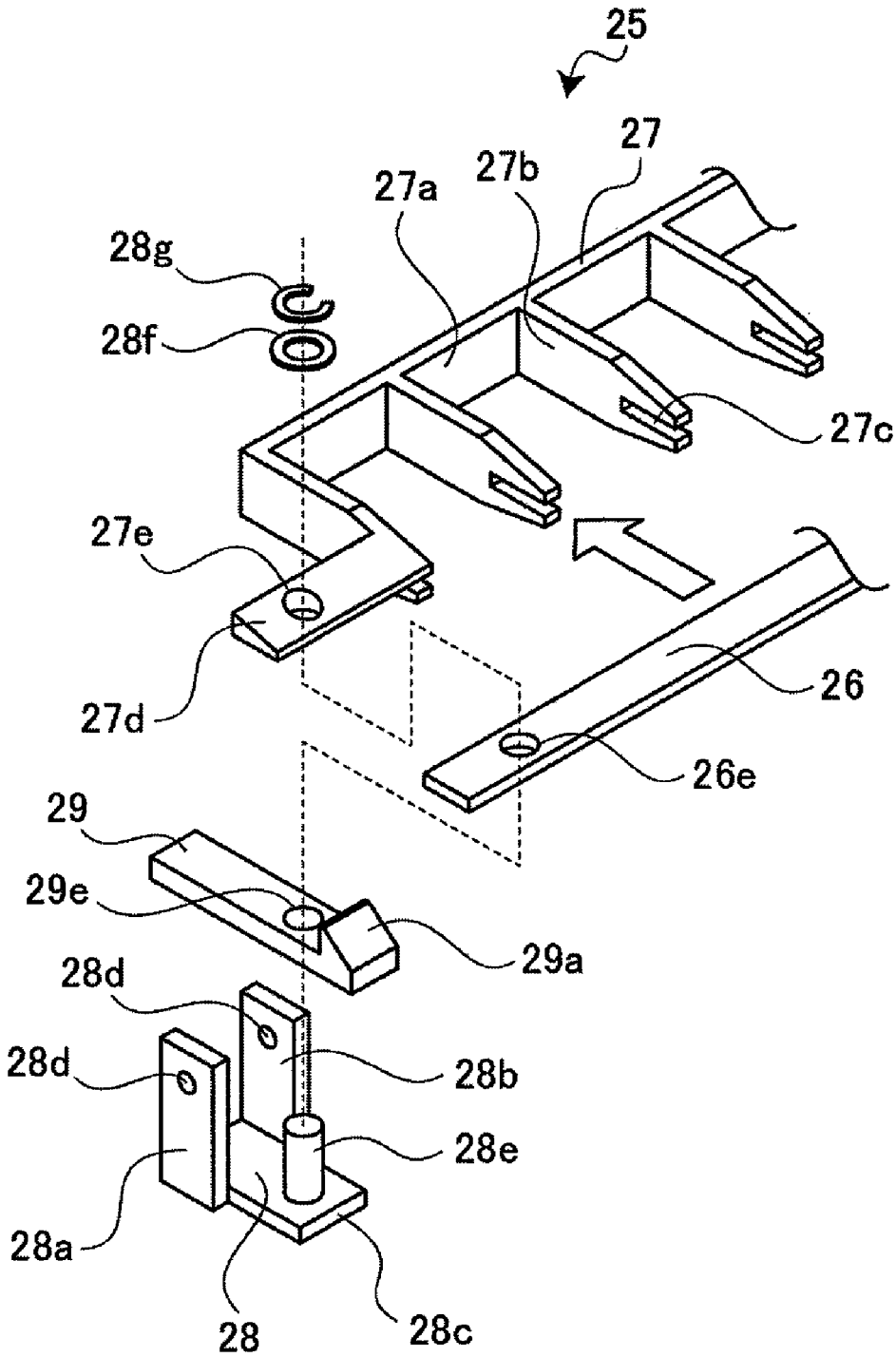
FIG. 16 is an exploded perspective view showing the separator arranged at the fixing apparatus according to the second embodiment of the invention.

FIG. 16 is an exploded perspective view of the separator. The spacer 29 is formed so that the post 28*e* of the bracket 28 is penetrated through the hole 29*e* of the spacer 29. The two brackets 28 having the spacer 29 are assembled by penetrating the post 28*e* through the hole 26*e* formed at each end of the metal plate 26 and through the hole 27*e* formed at each end of the sheet guide 27 while the metal plate 26 is fitted in the sheet guide 27. The front edge 29*a* of the spacer 29 is arranged at that time more closely to the fixing roller 2 than the metal plate 26. The bracket 28 is secured to each end of the metal plate 26 and the sheet guide 27 upon placing a washer 28*f* and a stopper ring 28*g* to the tip of the post 28*e*. The shaft 30 is made to penetrate the holes 28*d* of the bracket 28 provided at each end of the metal plate 26 and the sheet guide 27, thereby securing the separator 25 to the fixing apparatus 163. The separator 25 is arranged so that the front edge 29*a* of the spacer 29 contacts in a prescribed pressure to a non-printing region positioned at each end in the longitudinal direction on the surface of the fixing roller 2.

With this separator 25, similarly to the first embodiment, attachment of water droplets to the paper 24 is prevented because the vapor generated from the paper 24 during the fixing operation escapes upwardly through the openings 17. Since the openings 17 have a wider area than those in the first embodiment, the possibility to attach the water droplets becomes further lower. The metal plate 26 does not contact directly to the conveyed paper 24 because the metal plate 26 is assembled as to be sandwiched by the protruding portions 27*b*, so that the possibility to attach the water droplets is much more lowered. This apparatus also can prevent the paper 24 from partly highly glossing even where the paper 24 passing through the nipping portion becomes corrugated and subject to uneven contacts with the paper passing surface of the separator 25. This apparatus further can prevent a transparency rate from becoming uneven even where the medium is a recording medium different from the paper 24, such as an OHP sheet. It is unnecessary to coat a mold releasing agent on the surface of the metal plate 26, so that the apparatus according to this embodiment can expect manufacturing costs to be reduced.

Although in the above embodiments electrophotographic printers are exemplified, an image forming apparatus according to the invention is not limited to this, and is applicable to other apparatuses such as, e.g., facsimile machines, photocopiers, other printers, and multi-function peripherals.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A fixing apparatus comprising:

a fixing member for fixing developer on a recording medium; and a separation member for separating the recording medium from the fixing member to guide the recording medium in a delivery direction of the recording medium, the separation member comprising:

paper passing surface extending substantially parallel to a conveyance direction of the recording medium; and an opening extending through the paper passing surface, wherein the separation member is formed with a resin member and a metal member, and wherein a guide surface of the metal member, which guides the recording medium in the conveyance direction, is more projected than a guide surface of the resin member, which guides the recording medium in the conveyance direction, where the metal member is coupled to the resin member.

2. The fixing apparatus according to claim 1, wherein the opening is formed at a top surface of the separation member with respect to the recording medium to be conveyed.

3. The fixing apparatus according to claim 1, wherein the metal member is formed at a tip of the resin member.

4. The fixing apparatus according to claim 1, wherein the paper passing surface is formed with the resin member and the metal member.

5. The fixing apparatus according to claim 4, wherein the opening is formed with the resin member and the metal member.

6. The fixing apparatus according to claim 5, wherein the resin member is formed in a comb shape, wherein the metal member extends transversely, and wherein the resin member and the metal member form a plurality of openings.

7. The fixing apparatus according to claim 1, wherein the recording medium does not pass through the opening.

8. An image forming apparatus for forming a developer image on a recording medium, the image forming apparatus comprising:

an image carrier for forming a developer image on a surface thereof;

a transferring member for transferring developer image to a surface of the recording medium from the surface of the image carrier; and a fixing apparatus as set forth in claim 1.

9. The fixing apparatus according to claim 1, wherein the opening allows gas communication.

10. The fixing apparatus according to claim 1, wherein the resin member is formed with a base, and a plurality of protruding portions extending from the base forming a comb shape, and wherein the opening is formed between the metal member and the resin member by attaching the metal member to the protruding portions.

11. The fixing apparatus according to claim 1, wherein the metal member has a width equal to or narrower than a width of the opening formed between the metal member and the resin member.

12. The fixing apparatus according to claim 1, wherein the metal member is in a plate shape with major surfaces, and wherein a protruding portion is formed with a cutoff portion formed in a shape in contacting at least either major surface of the metal member for coupling to the metal member.

13. The fixing apparatus according to claim 1, wherein the metal member has a cross section in a letter L shape and is made of a stainless steel.

* * * * *